US006227439B1

(12) United States Patent
Hansen

(10) Patent No.: US 6,227,439 B1
(45) Date of Patent: May 8, 2001

(54) FLEXIBLE BAG IN THE BOX CONTAINER FOR LIQUIDS

(75) Inventor: Henrik Hansen, Tertnes (NO)

(73) Assignee: Multi-Pak AS, Sadviken (NO)

( * ) Notice: Subject to any disclaimer, the term of this patent is extended or adjusted under 35 U.S.C. 154(b) by 0 days.

(21) Appl. No.: 09/323,874

(22) Filed: Jun. 1, 1999

Related U.S. Application Data

(63) Continuation-in-part of application No. 09/117,192, filed on Jun. 28, 1999, now Pat. No. 6,170,739.

(51) Int. Cl.[7] ..... B65D 5/36

(52) U.S. Cl. ..... 229/117.05; 47/41.01; 229/104; 229/113; 229/117.04; 229/117.32; 229/164.2

(58) Field of Search ..... 229/104, 113, 229/117.03, 117.04, 117.05, 117.06, 117.32, 164.2; 47/41.01, 41.13

(56) References Cited

U.S. PATENT DOCUMENTS

| | | | | |
|---|---|---|---|---|
| 393,899 | | 12/1888 | Haines . | |
| 2,276,220 | | 3/1942 | LeVeille, Sr. . | |
| 2,432,052 | * | 12/1947 | Waters | 229/117.06 |
| 2,774,187 | | 12/1956 | Smithers . | |
| 2,869,722 | | 1/1959 | Marander et al. . | |
| 3,145,905 | | 8/1964 | Moore . | |
| 3,373,917 | | 3/1968 | Cox . | |
| 3,726,469 | | 4/1973 | Koehler . | |
| 3,912,331 | * | 10/1975 | Turner et al. | 229/104 |
| 4,109,848 | * | 8/1978 | Kipp et al. | 229/104 |
| 4,284,205 | * | 8/1981 | Hirata | 229/117.32 |
| 4,289,268 | | 9/1981 | Paige . | |
| 4,428,500 | | 1/1984 | Kohler . | |
| 4,792,086 | | 12/1988 | Chen . | |
| 4,850,509 | | 7/1989 | Hollenberg . | |
| 5,156,294 | | 10/1992 | Nichols . | |
| 5,788,061 | | 8/1998 | Hammond . | |

FOREIGN PATENT DOCUMENTS

| | | | | |
|---|---|---|---|---|
| 1586523 | | 4/1972 | (DE) . | |
| 2231557 | * | 11/1990 | (GB) | 229/117.05 |
| 943536 | | 3/1996 | (NO) . | |

* cited by examiner

*Primary Examiner*—Gary E. Elkins
(74) *Attorney, Agent, or Firm*—Fulbright & Jaworski, LLP

(57) ABSTRACT

Liquid resistant containers having double walled construction and an upwardly projecting container bottom are suitable for use, e.g., as a flower vase. Preferably, the containers are formed from a unitary carton blank having fold lines such that the container is prepared by folding the blank along fold lines to form the open-ended container, the cavity of which is lined with a liner or open bag to provide further resistance against leaks.

10 Claims, 15 Drawing Sheets

150
112
113
130
106
100d
160
161
162
105
103
107
101
120
102
104
142
141

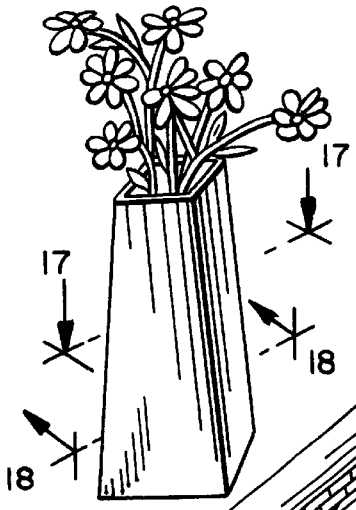
FIG.16
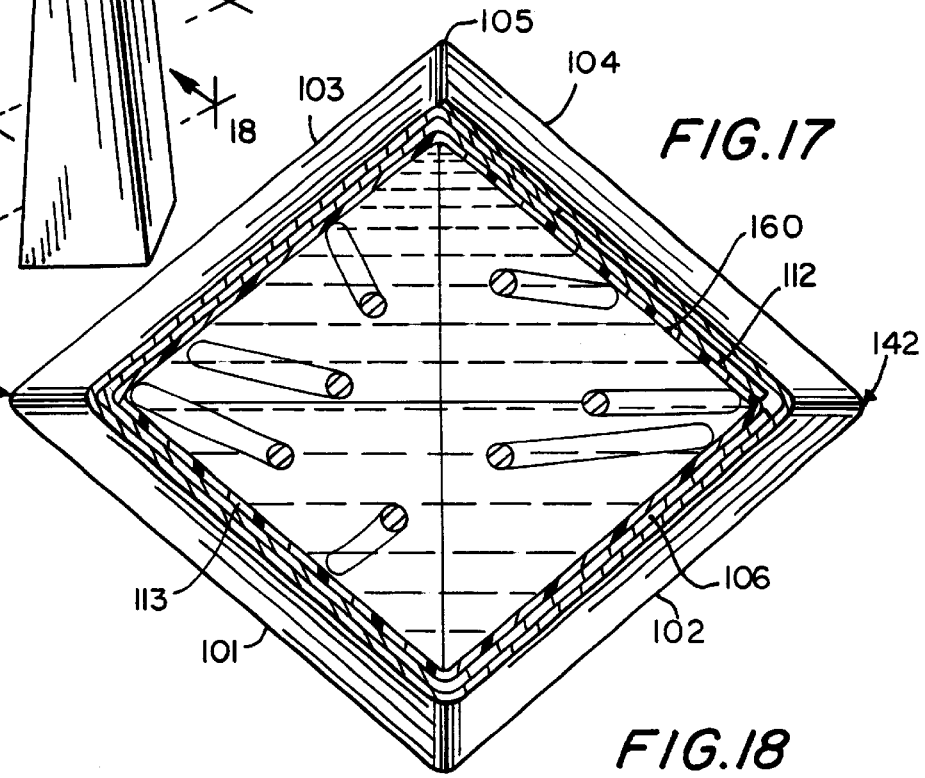
FIG.17
FIG.18
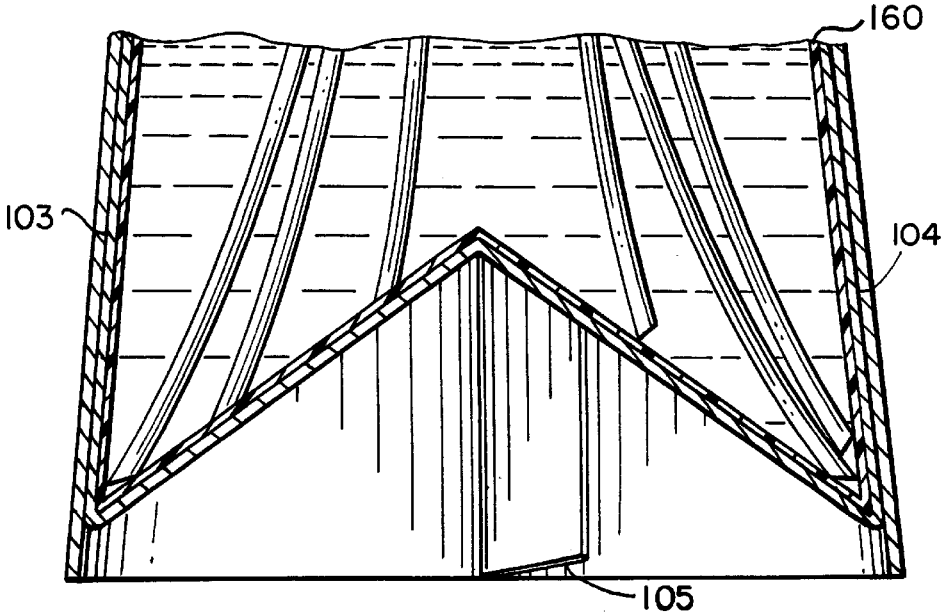

FLEXIBLE BAG IN THE BOX CONTAINER FOR LIQUIDS

RELATED APPLICATIONS

This application is a continuation-in-part of U.S. Ser. No. 09/117,192 filed Jun. 28, 1999 now U.S. Pat. No. 6,170,739, Jan. 9, 2001, which is a § 371 of PCT/NO96/00161, hereby incorporated by reference in its entirety.

BACKGROUND AND SUMMARY OF THE INVENTION

The present invention relates to a container which is preferably made of a liquid-resistant, planar blank of impregnated cardboard or like material formed via folding lines and edge flaps and having a bag affixed thereto. The container exists in a starting position in a flat, unfolded condition along a bottom folding line with a double foldable bottom portion. The bottom portion halves are adapted to be pulled in by a simple hand grip with a snapped or curved contour along the bottom folding line and thereby hold the container stretched in a ready-for-use condition by means of inherent elastic forces in the bottom portion of the container and adjacent container portions, forming a liquid-tight container inner portion with an associated bottom portion that is connected at opposite edges of the container inner portion to a container outer portion, to form a bracing, enveloping outer portion for the inner portion. A bag or liner is affixed to line the inner cavity that is formed. The container can serve a variety of uses, such as hot or cold beverage holders, flower vases, and the like.

Norwegian Patent Application No. 943536 discloses an extra bracing member which can overlap the bottom portion of the container in the ready-to-use position and which by means of inherent elasticity together with the elasticity in the bottom portion can maintain the container in place in a use ready condition. Further separate locking devices may also be used to lock the container in the ready-to-use position. Such separate locking devices can be, for example, fastened to the container at a local portion of its bottom portion by adhesion/welding. Such an extra locking device can, if desired, be made of corresponding material or of other material, and can have greater rigidity.

In practice, the container must be maintained in a ready-to-use position while avoiding unintentional collapsing of the container. The container of the present invention is a waterproof container capable of holding liquid having double-sided walls and a container bottom, the walls and bottom defining a cavity to hold a liquid. The container bottom is inwardly projecting, that is the bottom projects upward into the container cavity towards the container opening when in the ready-to-use position, and is collapsible so that in conjunction with fold lines in the walls of the container, the container can be stored in a flat or collapsed position. The outer wall of the container preferably extends at least partially beyond the bottom of the stabilizing container bottom to form the base of the container. The base is substantially the same shape as the cavity opening at the opposite end of the container, and is preferably larger than the cavity end, although embodiments where the base is of smaller dimension than the top are envisioned.

The container is preferably prepared from a unitary carton blank, although constructions are envisioned where several different pieces are adhered together to form the container of the invention and are meant to be within the scope of the claims appended hereto.

The container blanks of the invention are divided by a plurality of fold and/or score lines such that the container of the invention can be formed by folding the various sections of the blank to form the double walled container having a collapsible bottom portion that projects upward towards the opening of the container and maintains the container in the open position. The sections of the blank formed by the fold lines are further divided by additional fold lines which define the inner and outer side walls of the container.

The bottom edge of the outer side wall will form the base of the container. The liner, as noted above, are preferably attached to the blank prior to forming the finished container, but can be affixed to the inner walls defining the cavity after erection of the container to a ready to use position. The liner may also be affixed to the inside wall of the bottom of the container, but this is not required.

The container of the present invention is of the bag-in-the-box type and provides a combined collapsible bottom or bottom portion which stabilizes the bottom portion and opposite sides of the container in a direction across a central plane of the container through the bottom folding line of the bottom portion. This bottom structure (hereinafter "container bottom") includes a first, permanent bracing section, which is rigidly fastened to the bottom portion on the one side of the bottom folding line, and a second optionally, readjustable bracing section, which, when the container is in its flat starting position, projects freely outwards past the bottom folding line. The container bottom has great inherent rigidity in a direction across the bottom folding line and has a longitudinal dimension across the bottom folding line corresponding to or substantially corresponding to the breadth of the ready-for-use container in a direction across the bottom folding line. The container bottom thus provides stability to the container when in the ready-to-use position.

A waterproof bag or liner is provided in the interior cavity of the container to prevent leakage of liquids to be held in the container cavity. Preferably the liner is plastic, and may be a heat resistant plastic to hold a hot liquid, such as, e.g., soup.

The containers of the invention may also be prepared from several joined pieces of container blank in double walled construction having a cavity lined with the blank or liner.

In a preferred embodiment, a combined bottom-bracing and bottom-closing means ("bottom brace") is locally provided to the bottom of the container, to help prevent unintentional collapsing of the container when in use.

Without influencing the ability of the container bottom to be fixed in an elastically yielding manner, the flexibility and elasticity of the bottom portion is utilized in a favorable manner. In addition, an extra bracing and closing portion may be provided.

The liner or bag prevents leakage of liquids, making the container particularly useful as a flower vase. The container can also be used as a cup, a pharmaceutical dispenser, a specimen container, e.g., for urine, etc.

BRIEF DESCRIPTION OF THE FIGURES

Further features of the invention will be evident from the following description having regard to the accompanying drawings, in which:

FIG. 16 is a view of the container of the invention in the upright open position, shown as a vase.

FIG. 17 is a cross sectional view of the container shown in FIG. 16 along line 7—7.

FIG. 18 is a cross sectional view of the container shown in FIG. 16 along line 8—8 detailing the upward-folded bottom portion of the container.

DETAILED DESCRIPTION OF THE INVENTION

For purposes of the present invention, the "double-walled" refers to the fact that the outer walls of the container are at least double-walled for a portion of their dimensions. It should be understood that portions of the outer walls may be only of single-walled construction, e.g., around the base of the container, as is apparent from the following description.

To set forth some additional background, the container described in Norwegian Patent Application 943536 will be described and thereafter there is described a combined bottom-bracing and bottom-closing means according to the invention for closing off the container in the use ready condition.

Figure 1:
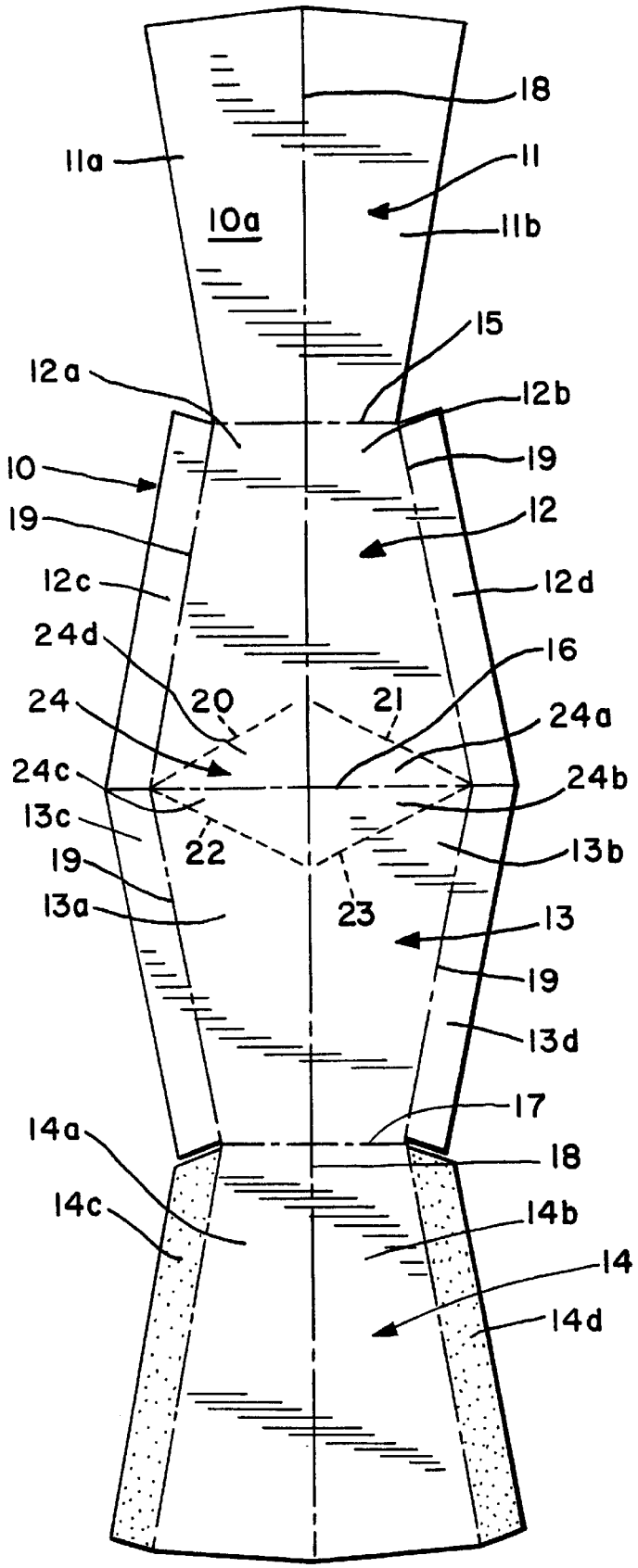
FIG. 1 PRIOR ART
FIG. 1 shows a blank in one piece for the making of a flower vase or similar container according to a known construction.
Figure 2:
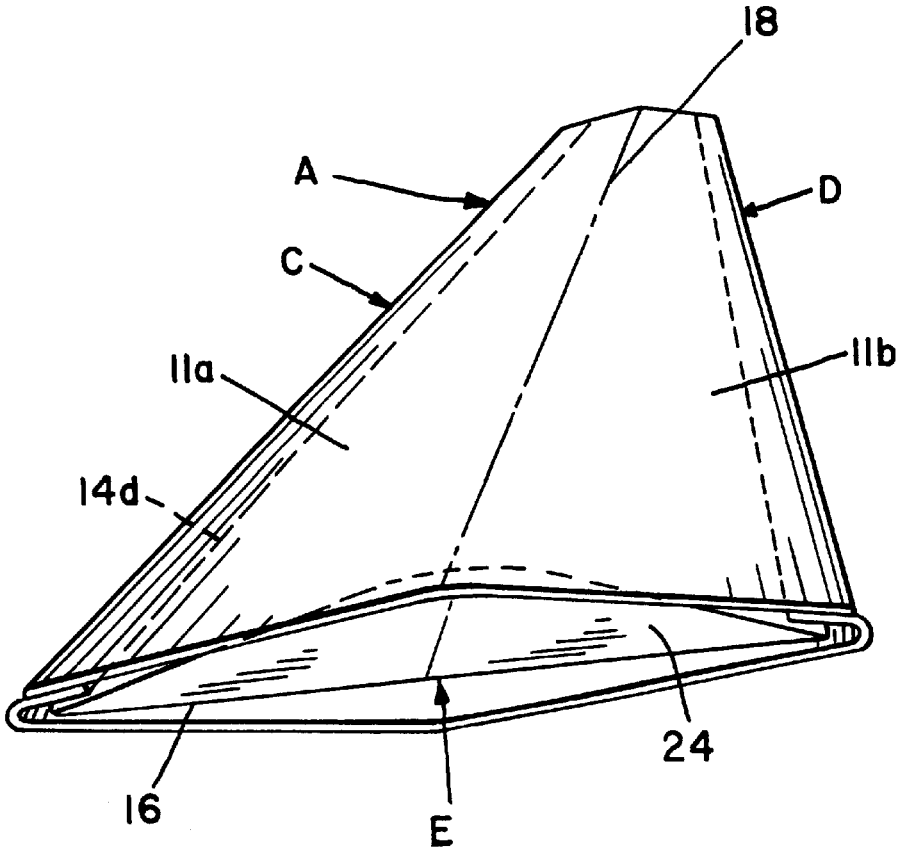
FIG. 2 PRIOR ART
FIG. 2 shows in perspective a folded together container made from the blank according to FIG. 1.
Figure 3:
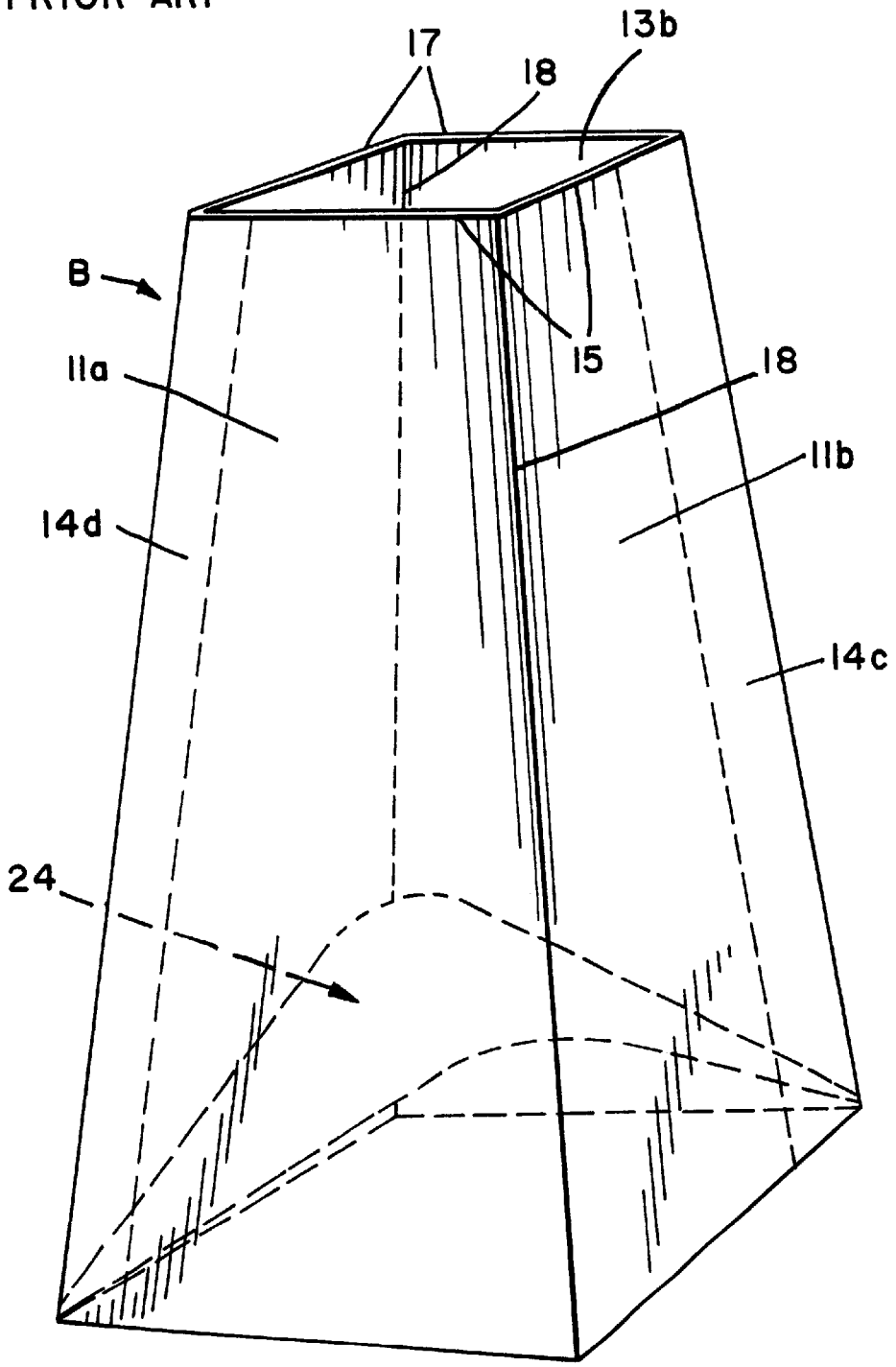
FIG. 3 PRIOR ART
FIG. 3 shows in perspective a flower vase or similar container in a use ready condition, made from the folded together container according to FIG. 2.

FIG. 1 shows a blank 10 described in NO 943536 of liquid-resistant cardboard for making an intermediate product in the form of a folded together container A, as shown in FIG. 2 and which in turn is to be formed into a finished product in the form of a container B, illustrated as a flower vase, in FIG. 3. It is advantageous that the container is easy to transform from an intermediate product A requiring little space to a use ready condition B, e.g., by manual manipulation.

The blank is preferably coated on the inner side 10*a* of the container (partially shown in FIG. 2) with a suitable liquid-resistant layer, such as a polyester coating, or another suitable material which can seal off the cardboard blank, although this is not required by the present invention. Suitable cartons can be prepared from any suitable material, e.g., corrugated cardboard, liquid-resistant paper, plastic, and the like. Combinations of these materials may also be used. Liquid resistant materials are not required since the containers are line, but they are preferred. By using a coating of polyester or another suitable thermoplastic, adhesion can be effected by local heating or by addition of another agent employed for welding of joints along edges of the intermediate product. A liner or bag is affixed on the inner side 10*a* by any means known in the art, e.g., an adhesive or mechanical converter such as a staple. The outer side 10*b* of the product the blank can be locally impressed with text or decorated. For example, the container can be impressed with a congratulatory greeting and/or have the possibility for additional manual inscription on a suitable area for this.

In other embodiments, the blank is not made of a waterproof material, but in all cases the liner is a waterproof material such as plastic.

Since the intermediate product A can be handled in a collapsed, relatively flat condition, the product is suited for easy handling.

In the illustrated embodiments, the blank is made of cardboard having 0.5–1.2 mm wall thickness and a fiber direction across the longitudinal direction of the blank, to utilize the thickness, rigidity and fiber direction of the cardboard. This ensures "elasticity" and strength of the container when in the ready-for-use (erected) condition, so that it can be gripped and handled in a reliable and stable manner with associated contents received in the inner portions 12, 13 of the container. Any suitable material can be used to form the blank, e.g., corrugated cardboard or paperboard, plastic, or the like. Combinations of such materials are also contemplated. For example, the inner walls of the carton may be made of a material different than the outer walls.

The blank 10 is divided up into four main sections 11–14 comprising two outermost end sections 11 and 14, which will form outer sides of the container, and two middle sections 12, 13, which will form inner sides of the container. These four sections are mutually separated by means of three mutually parallel, parallel extending folding lines 15, 16, 17. The blank is further provided with a central longitudinal folding line 18, which divides each section 11–12 into two mirror image-formed section portions 11*a*, 11*b* and 12*a*, 12*b* and which divides each section 13–14 into two equivalent mirror image-formed section portions 13*a*, 13*b* and 14*a*, 14*b* and also which divides a bottom portion 24 into four equivalent portions 24*a*–24*d*.

Along the side edges the middle sections 12, 13 and the one end section are provided with edge flaps 12*c*, 12*d*, 13*c*,

13*d* and 14*c,* 14*d,* which are defined by folding lines 19. In the central portion of the blank there are formed two substantially V-shaped folding lines 20, 21 and 22, 23, which define a rhombic portion, which is to form the inner bottom portion 24 of the object. As shown in FIG. 1 the portion 24 constitutes four right angled, substantially triangularly shaped portions 24*a,* 24*b,* 24*c,* 24*d.* By means of the rhombic bottom portion the container ban be made with a more or less marked rectangular bottom portion. Alternatively the folding lines 20–23 can extend with a bent or curved contour, so that there is defined an oval or more or less elliptical bottom portion (not shown further), which correspondingly can give the container a more or less rounded, that is to say oval or circular bottom portion.

The blank 10 is first folded together about the folding line 16, outer side against outer side. Thereafter the edge flaps 12*c* and 13*c* and 13*d* are bent round in pairs about the folding lines 19 and folded together in layers against each other. Adhesive agent is applied or alternatively there is applied in advance an adhesive agent to the blank, such as an impregnating agent in the form of polyester or other suitable thermoplastic. Thereafter the joint connections can be adhered together, that is to say each of the opposite sides of the edge flaps, by a conventional welding operation or adhesion operation, so that a liquid-tight inner container is obtained.

Thereafter section 14 of the blank 10 is folded about the folding line 17, with abutting inner side against inner side, and the edge flaps 14*c* and 14*d* are folded on the outside of the folded together sections 12, 13. Finally, the section 11 is folded around about the folding line 15 and is pressed against the pack of inner sides 12, 13 and edge flaps 14*c,* 14*d* of the outer side 14. Finally the edge flaps 14*c,* 14*d* carrying the adhesive agent or carrying the impregnating agent are firmly adhered by adhesion/welding to the section 11 via associated connection joints. If desired portions of the inner sections can be simultaneously adhered to the outer sections.

After the adhesive agent/thermoplastics has hardened the intermediate product A assumes a position as shown in FIG. 2, that is to say an intermediate product in the form of a flat container-forming pack. There is formed consequently a double-walled intermediate product having double edge joints. The one, inner joint connection seals off the inner portion of the container and the other, outer joint connection forms an enveloping, outer container portion 11, 14 which braces and shores up inner portions 12, 13 of the container.

In FIG. 3 there is shown the end product B according to the known construction. The end product comes to light in that the intermediate product A (FIG. 2) is squeezed together sideways, as is shown by the arrows C and D. The squeezing force will cause the bottom portion 24 to be "drawn" upwards and inwards into the container, as shown by the arrow E. Alternatively the bottom portion 24 will be pressed in with a pushing force, as is shown by the arrow E in FIG. 2. By this the bottom portion 24 will be pressed upwards and inwards in the end product by bending around about a dead center in a plane through the folding line 18, while side walls of the container are equivalently stretched out to the form which is shown in FIG. 3. It will also be possible to effect a manual stretching out of the sides as shown by the arrows C and D at the same time as manual pressing in of the bottom portion is effected as shown by the arrow E. A container B is hereby produced, which is shown widest below and narrowest above and which is thereby well suited for example as a slim flower vase having a low center of gravity and having a favorable bottom support effect.

On squeezing together the container B in a plane through the folding line 16 the container according to the known construction can, relatively easily, be squeezed together from the position which is shown in FIG. 3 to the position which is shown in FIG. 2.

According to the invention there is fastened a bottom brace 25 to the bottom portion 24 of the flower vase/container B1 for effectively being able to brace and close the container B1 in a use ready condition against unintentional folding together. In the illustrated embodiment the bottom brace 25 is adapted to exert an effective closing off effect, that is to say that only by a deliberate lifting of the closing engagement can the bottom brace 25 be readjusted from the active closing position, as shown in FIG. 5, to an inactive storing position, as shown in FIG. 4, in connection with an intentional readjustment of the container from a stretched out to a folded together condition.

Figure 4:
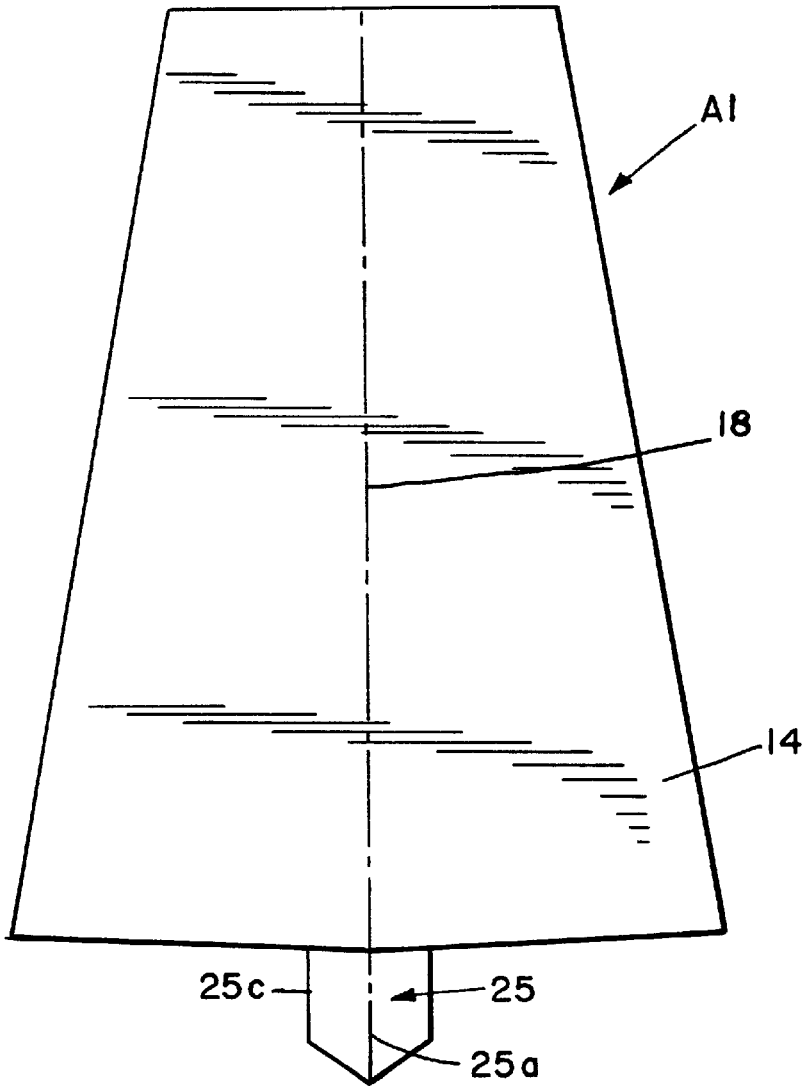
FIG. 4 shows in a plan view a flower vase in a first embodiment according to the invention, illustrated in a folded together condition with a combined bottom-bracing and bottom-closing means projecting freely outside the bottom edge portion of the flower vase.
Figure 5:
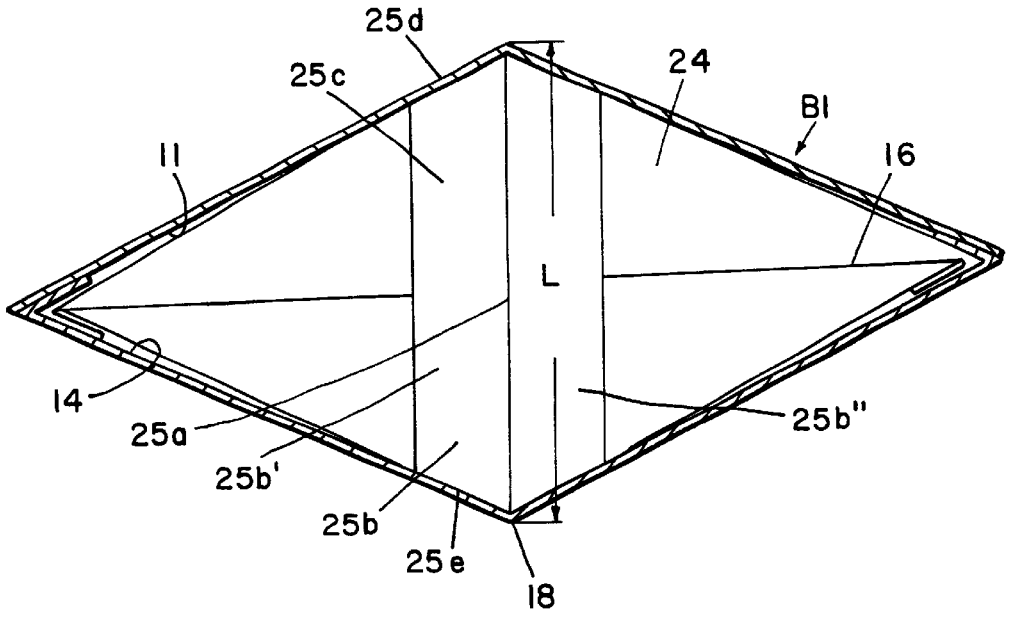
FIG. 5 shows a bottom view of the flower vase according to FIG. 4 with the bottom-bracing and bottom-closing means illustrated in a closed position in the use position of the vase.

In FIGS. 4 and 5 the bottom brace 25 is shown in the form of a strip of relatively bending rigid cardboard and provided with a longitudinal, middle attenuation line 25*a*. The breadth of the strip in the illustrated embodiment is of a magnitude ⅕ the length of the bottom folding line. In practice the breadth can be considerably broader, but the container B1 then becomes more difficult to position back from the stretched to the folded together condition.

Alternatively a more stable strip of plastic or other suitable material can be employed.

In FIG. 4 the container/intermediate product A1 is shown in a folded together condition and the bottom brace 25 is shown in an inactive condition. One end 25*b* of the bottom brace 25 is fastened to the one half of the bottom portion 24, while its other end 25*c* projects freely outwards from the bottom portion 24 and further axially outside the container/intermediate product A1 in the folded together condition. In the illustrated construction only the one half 25*b*' of end 25*b* of the means 25 is fastened to the bottom portion, while the other half 25*b*' projects freely outwards past the attenuation line 25*a*.

In FIG. 5 the container B1 is shown in a stretched condition and the bottom brace 25 is shown in an active closing position on the under side of the middle portion of the bottom portion 24. In FIG. 5 there is shown the attenuation line 25*a* extending in a lowermost layer formed by the bottom brace 25 and the bottom folding line 16 extending in a direction crossing an upper layer formed by the bottom portion 24 of the container B1. An effective support can be achieved hereby by means of the folding edge which is formed by the attenuation line 25*a* and the elasticity in the bottom portion 24 along the outstretched folding line 16.

The bottom brace 25 becomes, as a result of it being firmly adhered to the one half of the bottom portion 24 of the container B1, swung about together with this bottom portion half from the inactive position shown in FIG. 4 to the closed position shown in FIG. 5.

The bottom brace 25 has a length L, which roughly corresponds to the internal distance between opposite sides 11 and 14 of the ready shaped container B1, so that end edges 25*d* and 25*e* of the closing bottom brace can form an endwise supporting abutment against opposite sides 11, 14 of the container B1.

However, when desired, the closing bottom brace 25 can be manually drawn away from the closing engagement and thereafter, for example by exerting a pull at the outer end 25*c* of the closing means the container B1 can be actively readjusted to the folded together condition, as shown at A1 in FIG. 4.

Figure 6:
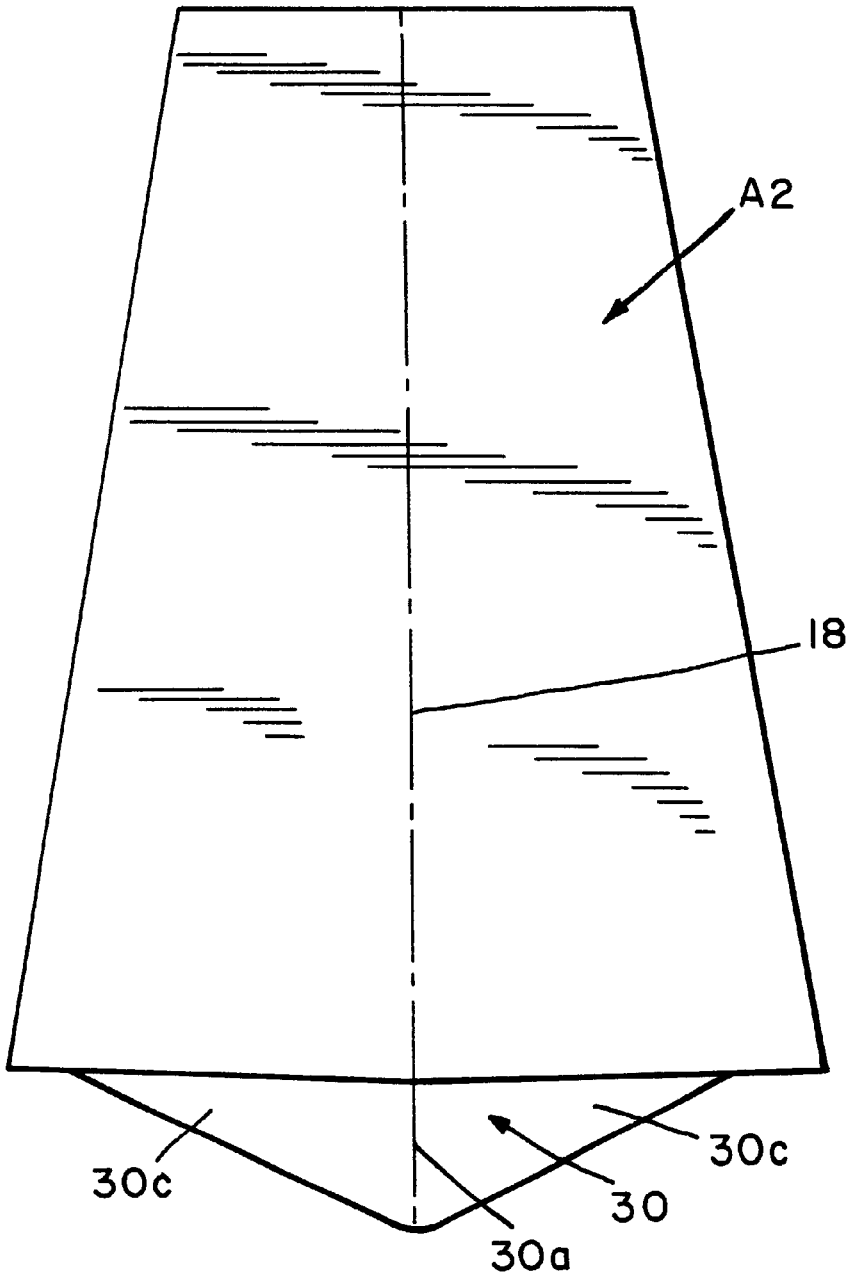
FIG. 6 shows in plan view a flower vase in a second embodiment according to the invention, illustrated in a folded together condition with a combined bottom-bracing and bottom-closing means projecting freely outside the bottom edge portion of the flower vase.
Figure 7:
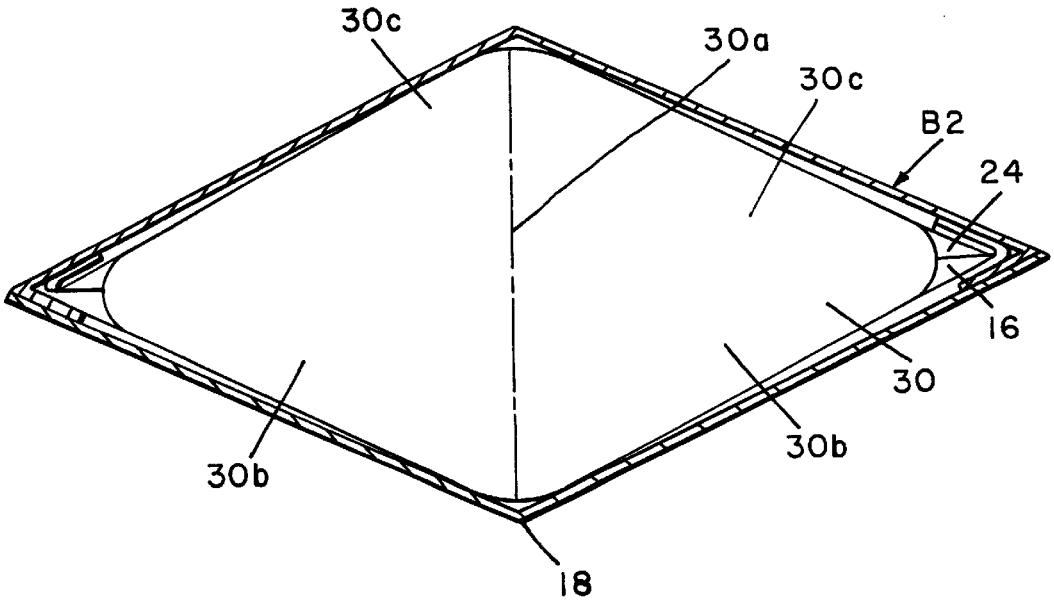
FIG. 7 shows a bottom view of the flower vase according to FIG. 6 with the bottom-bracing and bottom-closing means illustrated in a closed position in the use position of the vase.

In FIGS. 6 and 7 an alternative construction of the container A2 and B2 is shown based on a bottom brace. In the use position of the container B2, as is shown in FIG. 7, the means 30 covers so to speak the whole of the container bottom 24 of the container B2. In FIG. 7 there is shown a middle weakening line 30*a* having a contour at right angles to the bottom folding line 16, that is to say with a contour corresponding to the attenuation line 25*a* as shown in FIG. 5. Alternatively, the attenuation line can be omitted. The one half 30*b* of the means 30 can be fastened to the whole under side or parts of this to the bottom portion 24, while the other half 30*c* of the means projects endwise outside the container A2, as is shown in FIG. 6.

Figure 8:
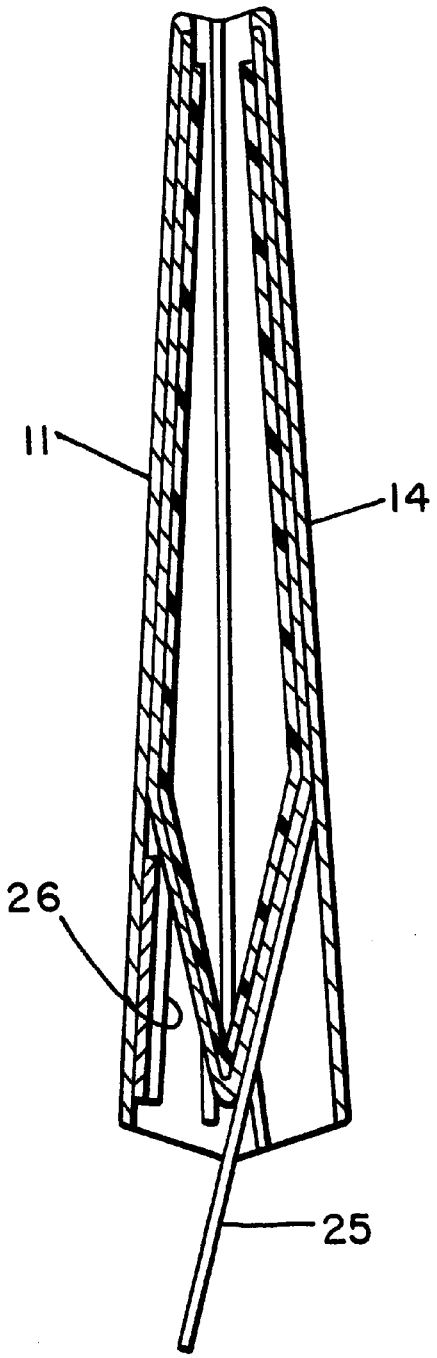
FIG. 8 shows a vertical section of a flower vase according to a third embodiment with the vase illustrated in the folded together position.
Figure 9:
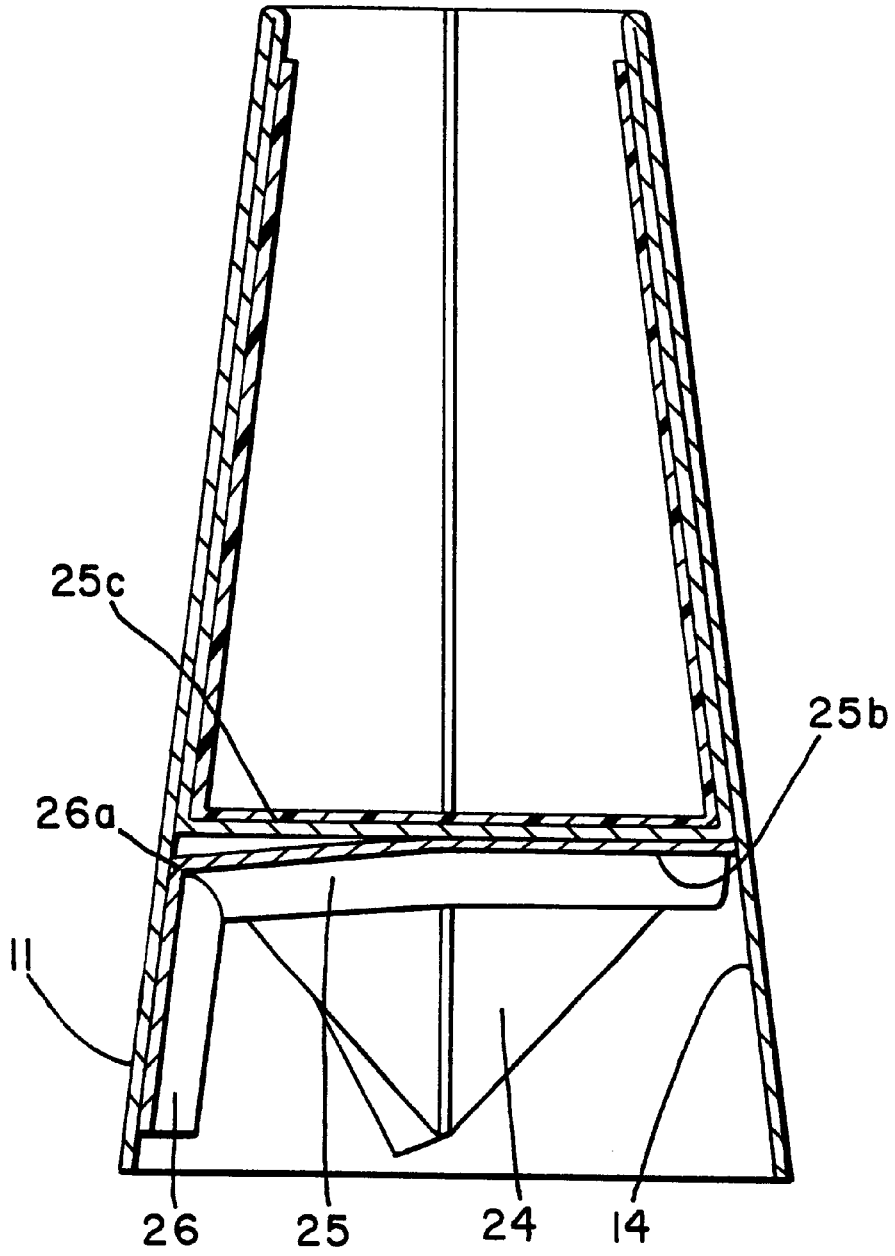
FIG. 9 shows the flower vase according to FIG. 8 in a corresponding vertical section, as illustrated in FIG. 8, in a finished use position.
Figure 10:
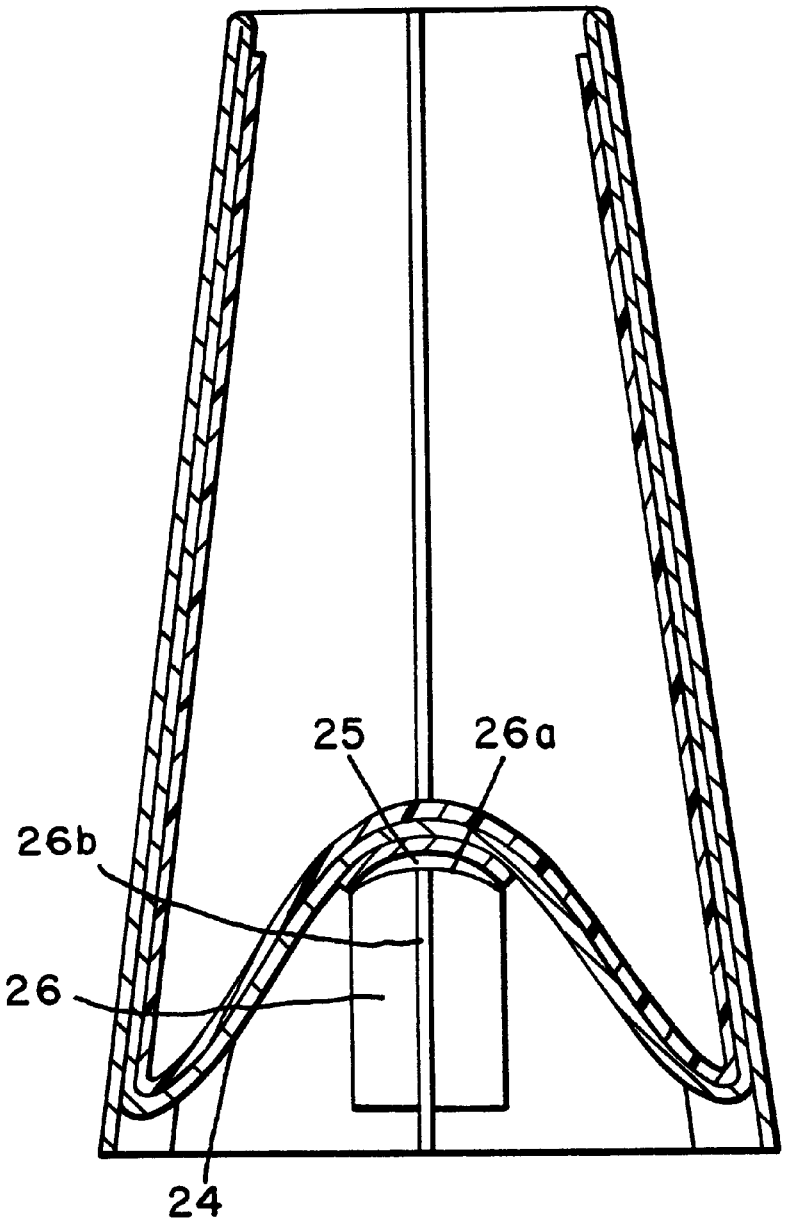
FIG. 10 shows the flower vase according to FIG. 8 in a finished use position, illustrated in a vertical section at right angles to the section of FIG. 9.

A first simple design of the closing mechanism includes only the bottom brace 25 (FIGS. 4–5) and 30 (FIGS. 6–7) respectively, which is fastened to the bottom portion (container bottom) 24. In order to ensure an additional closing of the container bottom 24 in its closing position there is illustrated in FIGS. 8–10 a further embodiment having an extra stopper for a closing corresponding to the container 25 according to FIG. 4–5 so that an especially shape stable closing means of great inherent rigidity can be obtained. The stopper 26 is shown in the form of a cardboard flap, which is fastened to the inner side of the one outer wall 11 of the container.

As shown in FIGS. 9–10 the bottom brace 25 rests in the closing position against upper edge surface 26*a* of the cardboard flap 26. The stopper 26 can, in the dimension it is employed, close the closing means in place in a permanently closed condition and in addition the stopper/cardboard flap 26 can by its fastening to the outer wall of the container locally brace this in a region just by the supporting abutment of the closing means against the outer wall of the container in order to support the outer wall in an intentionally uniform contour. In a case where there is desired a marked edged container outer wall the cardboard flap 26 can be provided with a folding line 26*b,* as is shown, while such a folding line in the cardboard flap 26 (and in the container wall 11 and 14 respectively) is omitted if such a marked edged container outer wall shall be avoided.

A preferred embodiment of the invention is shown in FIGS. 11 through 18.

Figure 11:
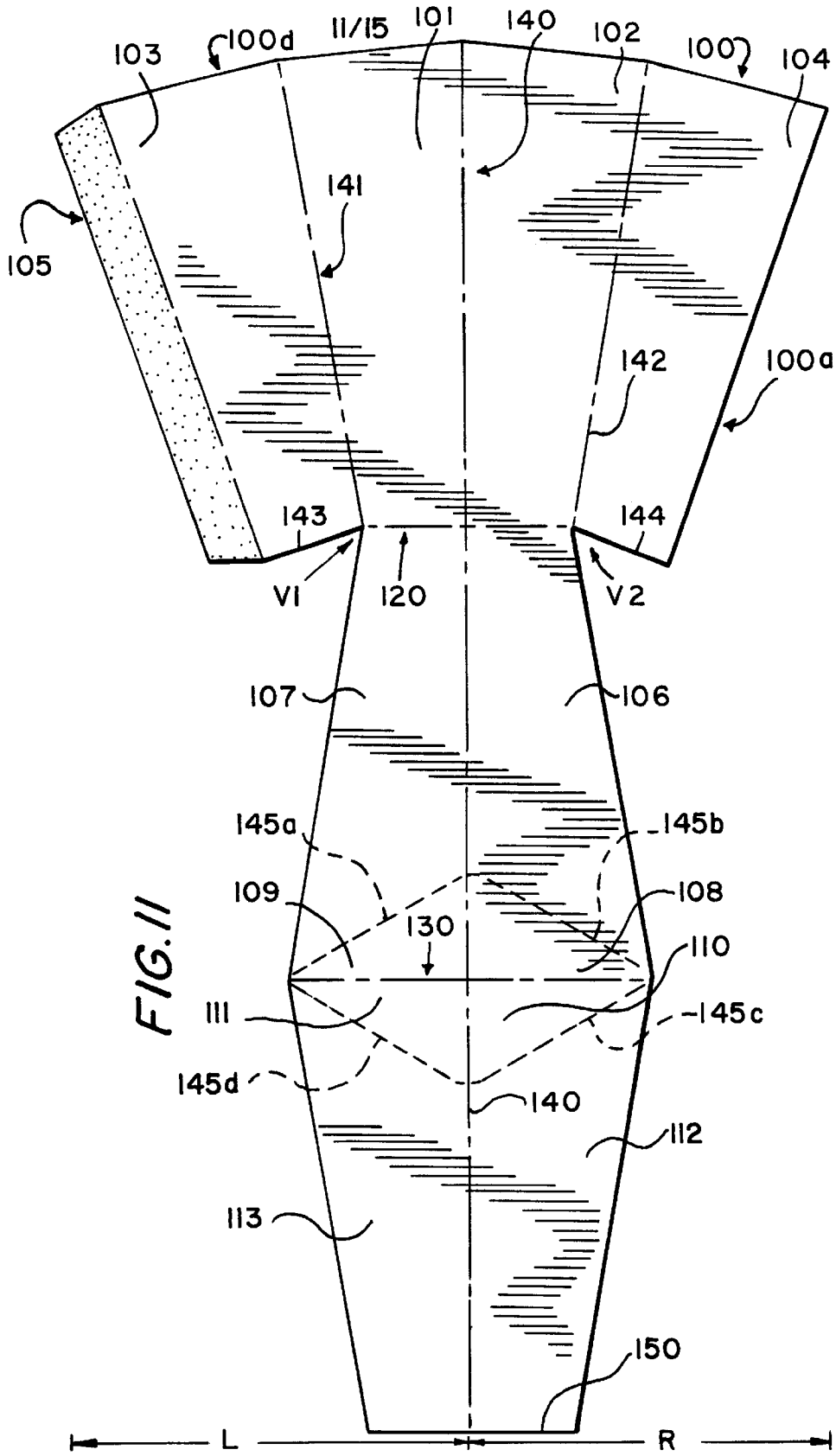
FIG. 11 shows a preferred carton blank used to prepare the container of the present invention.
Figures 12, 15:
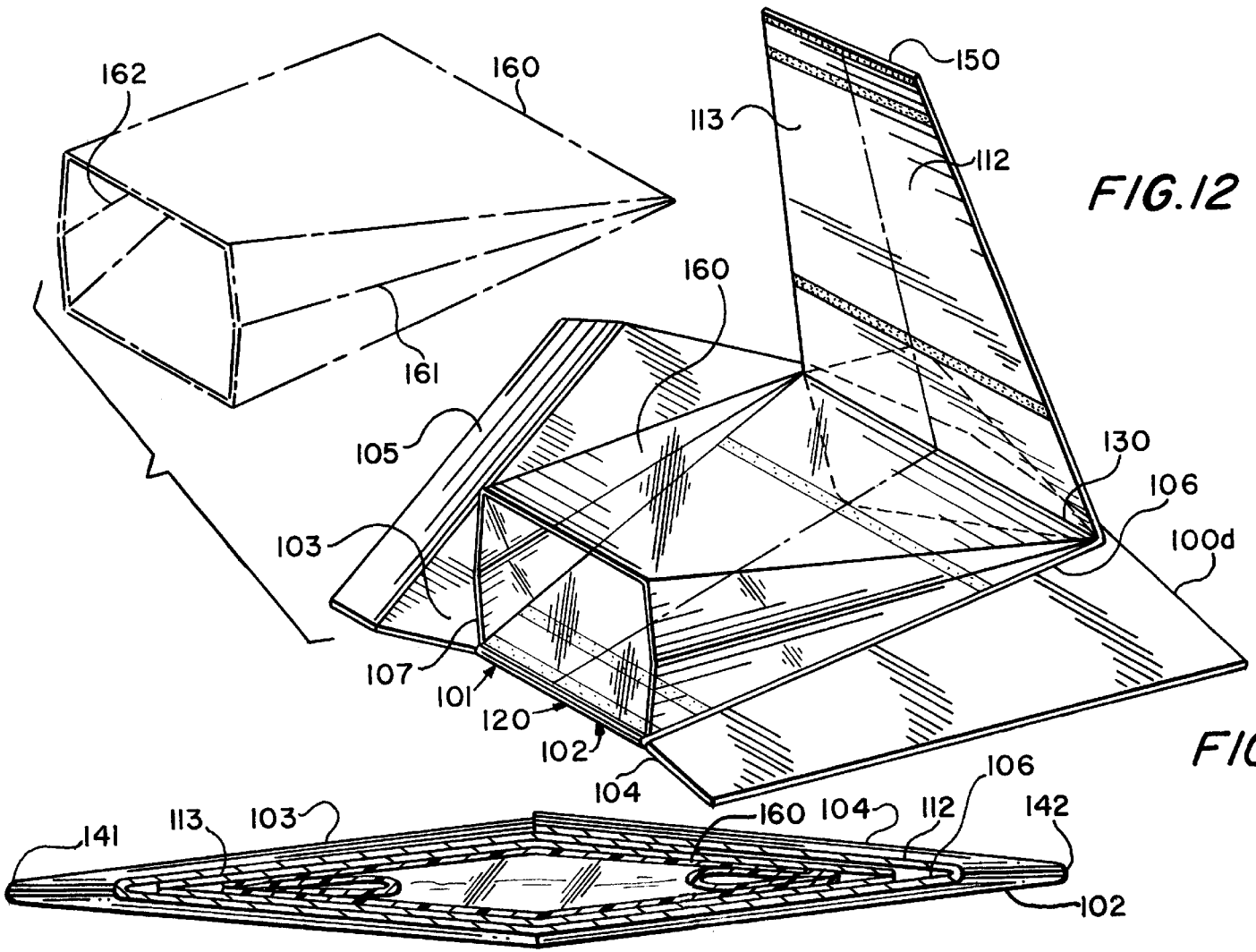
FIG. 12 is a partially folded view showing the bag or liner.
FIG. 15 is a cross-section of the container shown in FIG. 3 along line 5—5.
Figure 13:
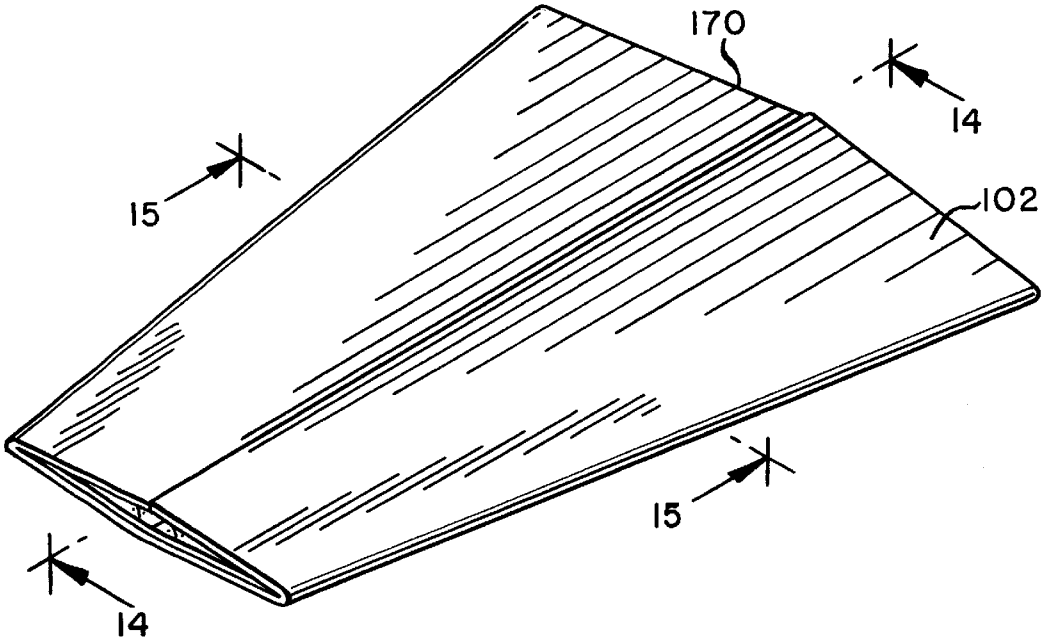
FIG. 13 is a view of the container folded flat.
Figure 14:
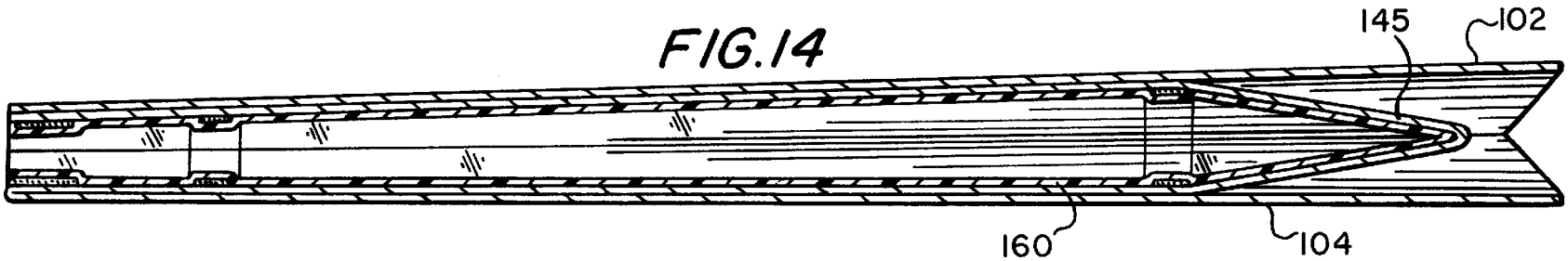
FIG. 14 is a lengthwise cross-section of the container shown in FIG. 3 along line 4—4.
Figure 19:
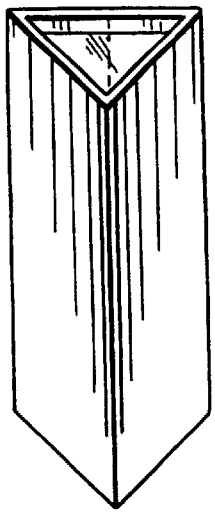
FIG. 19 shows a container of the present invention that is triangular in shape.
Figure 20:
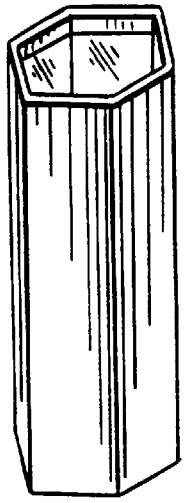
FIG. 20 shows a container of the invention that is hexagonal in shape.
Figure 21:
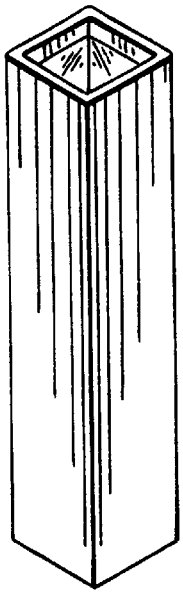
FIG. 21 shows an embodiment of the invention that is square-shaped.
Figure 22:
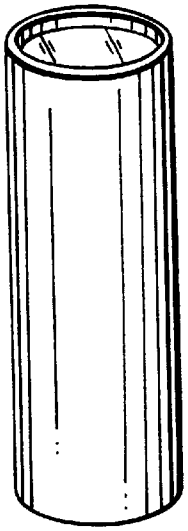
FIG. 22 shows an embodiment of the invention that is cylindrical.

Referring to FIG. 11, a unitary carton blank 100 is formed from a liquid resistant material, such as cardboard coated or lined with an appropriate liquid-proof polymer. The carton blank is divided into a top section 100*a,* a middle section 100*b* and a bottom section 100*c,* which are formed by fold lines 120 and 130. Vertical fold line 140 divides the carton into right (R) and left (L) sections.

Top section 100*a* is further divided into left and right central portions 101, 102 and left and right outer portions 103, 104 by fold lines 140, 141, and 142. Fold line 140 runs through the entire midsection of the carton blank, forming right and left sides of the blank. Fold lines 141 and 142 run from carton blank edge 100*d* to fold line 120 at an appropriate angle such that when in a ready-to-use position, the container bottom is wider than the container top to stabilize the container and avoid tipping. The bottom edge of left and right sections 103, 104 are edges 143, 144 which extend outwardly to the left and right beyond fold lines 120 forming V-shaped notches V1 and V2

A glue flap 105 is formed at the outer edge of right outer section 103 by fold line 143 and is contiguous therewith. Edge 100*d* is appropriately formed to provide a base for container 100, as is evident from the description and drawings.

Middle section 100(*b*) is divided centrally into right and left portions 106 and 107 by central fold line 140, and is bounded at the top by fold line 120 and at the bottom by fold line 130. Bottom section 100(*c*) is a mirror image of middle section 100(*b*). A stabilizing container bottom is formed near the base of middle section 100(*b*) and the top section of bottom portion 100(*c*), about fold line 130 and central fold line 140. This container bottom 145 is formed by score line 145*a,* 145*b,* 145*c* and 145*d* which extend from the right and left ends of fold line 130 at an angle to central fold line 140, shown in FIG. 1 as a diamond shape having four substantially right triangular divisions, with fold line 130 and 140 intersecting to form the right angle.

A liner or open bag 160 is adhered to the middle and bottom sections, which, when the container is formed, will define an interior space or cavity to hold a liquid (FIGS. 2, 4 and 5). The bag 160 is affixed such that the bag top, i.e., the open end, is adhered near the top of middle section 100*b* and, on the opposite side near the bottom of bottom portion 100*c*. Bag 160 has fold lines 161, 162 to assist folding of carton 100, although such fold lines are not required.

Bottom portion 100*c* is folded along fold line 130 such that its inner face is opposite the inner face of middle section 100*b,* with the bag affixed therebetween. When folded in this manner, it is seen that the bottom portion of bottom section 100*c* and the top edge of middle section 100*b,* i.e., score line 120, along with the bag, will form a portion of the cavity in which, e.g., flowers, may be placed (FIG. 8).

The top section 100*a* is then folded downward and around the middle section 100*b* and bottom section 100*c* to envelope these as well as the bag 160.

The right outer portion 103 is then folded along with glue flap 105 and left flap 104 is then folded over top of glue flap 105 and affixed thereto with an appropriate adhesive or bonding material. Thus, the outer edge of outer portion 104 meets with fold line 143 dividing right outer portion 103 and glue flap 105.

As can be seen in FIG. 8, the top edge 100*d* of the top portion forms the base of the container. Central sections 101 and 102 fold along fold line 140 and are adjacent right and left portions 106 and 107 of middle section 100*b,* while outer portions 104 and 105 correspond to sections 112 and 113.

The carton base 120 showing the foldable stabilizing portion formed along fold lines 130 and 140 is shown in FIG. 8. Application of a force tangential to the intersection of fold lines 130 and 140 causes an upward movement of the stabilizing base such that the ends of fold line 130 exert an outward force against fold lines 141 and 142, while the folded portions of central fold line 140 exert an outward force against portions of fold line 140 and 143. These outward forces maintain rigidity of container 100 in the erect position, provides a stabilizing force to the base of the container formed by edge 140 and maintains a cavity formed along edge line 120 and edges 144 and 145 of top section 100*a*.

The container 100 may be kept in a flattened position (FIG. 3) until ready for use. (FIGS. 6–8). Additional stabilizing tabs or pull-out tabs can be affixed to the bottom as with the first preferred embodiment.

In preferred embodiments, a stabilizing flap may be adhered to the bottom portion that can provide additional stability to the container base.

FIGS. 17 and 18 show cross-sectional views of the container shown in FIG. 16. FIG. 17 is a cross-section of an erected container along line 7—7, containing flowers. Outer walls 101–104 are shown with their respective inner walls, and glue flap 105 is also shown. FIG. 18 is a cutaway view of the base section of the container shown in FIG. 16, showing outer walls 103 and 104 and their respective inner walls, as well as liner 160 bonded thereto.

Figure 23:
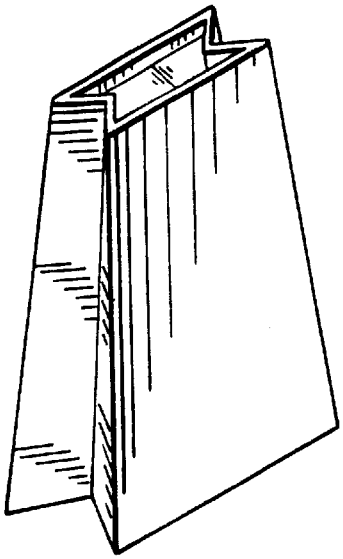
FIG. 23 shows a six-sided container according to the invention that has trapezoidal front and back sides.

FIGS. 19–23 show alternate shapes of the containers of the invention, including triangular (FIG. 19), hexagonal (FIG. 20), square (FIG. 21), cylindrical (FIG. 22), and substantially trapezoidal (FIG. 23). Each has double walled construction, and an upwardly folding base (not shown). The cylindrical embodiment of FIG. 22 folds flat into a rectangular shape, and is preferably not formed from a unitary carton blank. Each has a cavity lined with a bag or liner.

It is possible to give the end product a shape other than that illustrated, which has upwardly converging edges and upwardly converging outer sides and a generally pyramidal shape. Alternatively, the container can be given upwardly diverging edges and upwardly diverging outer sides, so that a container is formed having the largest breadth above and the least breadth below. Further variations can consist in employing mutually parallel edges and mutually parallel sides with a corresponding breadth above and below (not shown).

Many uses are envisioned for the containers of the present invention, including beverage containers, specimen cups, liquid pharmaceutical dispensers, soup containers, flower vases, and other applications where it is necessary to contain a liquid.

For example, when used as a vase, a bouquet of flowers which is received in the vase can distribute some of the flower stems sideways on each side of the convexly curved bottom portion, with corresponding spreading out of the flower bouquet above over the upper end of the vase.

Other embodiments of the invention will be apparent to those skilled in the art and are meant to be within the scope of the claims appended hereto.

What is claimed is:

1. A liquid-resistant container comprising:

a planar carton blank of impregnated cardboard, said blank having folding lines and edge flaps wherein the blank is folded to form the container, said container having a double folded bottom portion formed by bottom portion halves, the bottom portion halves of which are adapted to be pulled in by a simple hand grip with a snapped or curved contour along the bottom folding line and thereby hold the container stretched in a ready-for-use condition by means of inherent elastic forces in the bottom portion of the container and adjacent container portions, where a liquid-tight container inner portion with associated bottom portion, a liner or bag being present in the inner portion is connected at opposite edges of the container inner portion to a container outer portion, which forms a bracing, enveloping outer portion for the inner portion, wherein a bottom brace and bottom-closing means is adapted to brace bottom portion and opposite sides of the container in a direction across a central plane of the container through the bottom folding line of the bottom portion, wherein the container is waterproof.

2. The container of claim 1, wherein the shape of the container is selected from the group consisting of pyramidal, triangular, hexagonal, square, cylindrical, or substantially trapezoidal.

3. The container of claim 1, wherein said material is selected from the group consisting of corrugated cardboard, plastic, and water resistant cardboard.

4. An open liquid-resistant container comprising:

a carton blank, said carton blank having a plurality of fold lines dividing the carton blank into at eight wall sections and a foldable container bottom portion, wherein walls of the carton blank, when folded to form the container form four double-walled side walls having inner walls and outer walls formed by said wall sections, said inner walls of said double-walled side walls and the bottom container portion defining an inner container cavity, said container having at least a first edge of the blank adhered to at least one of said side-walls, said blank having a bag or liner affixed thereto such that the bag or liner lines said inner cavity.

5. The container of claim 4, wherein said carton is made from a material selected from the group consisting of corrugated cardboard, plastic, and water resistant cardboard.

6. The container of claim 4, wherein the shape of the container is selected from the group consisting of pyramidal, triangular, hexagonal, square and substantially trapezoidal.

7. A container blank for preparing a waterproof double walled carton comprising:

a unitary sheet of material, said sheet divided by score lines into a plurality of wall sections and a collapsible bottom portion having a plurality of bottom sections, said plurality of wall sections further divided by vertical fold lines to form the walls of the container when the blank is folded to form the container, the each said wall having two layers when the carton is in the ready-to-use position, a liner or bag being affixed to the blank in such a manner that, when the container is formed, the liner lines the cavity defined by the inner side walls and bottom of the container, the container having at least three walls and a matching number of bottom sections.

8. The carton blank of claim 7, wherein said material is waterproof.

9. The container blank of claim 3, wherein said sheet of material is selected from the group consisting of corrugated cardboard, plastic, and water resistant cardboard.

10. The container blank of claim 3, wherein the shape of the container blank is shaped such that, when erected to form the container, the container is a shape selected from the group consisting of pyramidal, triangular, hexagonal, square and substantially trapezoidal.

* * * * *

UNITED STATES PATENT AND TRADEMARK OFFICE

CERTIFICATE OF CORRECTION

PATENT NO. : 6,227,439 B1
DATED : May 8, 2001
INVENTOR(S) : Hansen

It is certified that error appears in the above-identified patent and that said Letters Patent is hereby corrected as shown below:

Title page,
In the section entitled U.S. PATENT DOCUMENTS, change "7/1989 Hollenberg" to -- 1/1989 Hollenberg --.

Signed and Sealed this

Eighth Day of January, 2002

*Attest:*

*Attesting Officer*

JAMES E. ROGAN
*Director of the United States Patent and Trademark Office*